United States Patent [19]

Agrawal et al.

[11] Patent Number: 4,464,188

[45] Date of Patent: Aug. 7, 1984

[54] PROCESS AND APPARATUS FOR THE SEPARATION OF AIR

[75] Inventors: Rakesh Agrawal, Allentown; Thomas E. Cormier, Schnecksville, both of Pa.

[73] Assignee: Air Products and Chemicals, Inc., Allentown, Pa.

[21] Appl. No.: 536,426

[22] Filed: Sep. 27, 1983

[51] Int. Cl.[3] ..... F25J 3/02

[52] U.S. Cl. ..... 62/13; 62/30; 62/31; 62/39

[58] Field of Search ..... 62/13, 14, 15, 18, 29, 62/30, 31, 38, 39

[56] References Cited

U.S. PATENT DOCUMENTS

| | | | |
|---|---|---|---|
| 2,627,731 | 2/1953 | Benedict | 62/175.5 |
| 2,982,108 | 5/1961 | Grunberg et al. | 62/28 |
| 3,492,828 | 2/1970 | Ruckborn | 62/13 |
| 3,736,762 | 6/1973 | Toyama et al. | 62/13 |
| 4,222,756 | 9/1980 | Thorogood | 62/13 |
| 4,400,188 | 8/1983 | Patel | 62/13 |

*Primary Examiner*—Frank Sever

*Attorney, Agent, or Firm*—Geoffrey L. Chase; E. Eugene Innis; James C. Simmons

[57] ABSTRACT

A process and apparatus is set forth for the separation of air by cryogenic distillation in a rectification column using two nitrogen recycle streams and a sidestream of the feed air stream to reboil the column. One of the nitrogen recycle streams is expanded to provide refrigeration and to provide power to compress the feed air sidestream.

15 Claims, 1 Drawing Figure

PROCESS AND APPARATUS FOR THE SEPARATION OF AIR

TECHNICAL FIELD

The present invention is directed to the separation of air into its constituents, nitrogen and oxygen. Specifically, the invention is directed to the cryogenic distillation of air to produce a nitrogen product and an oxygen-enriched product. More specifically, the invention is directed to a cryogenic distillation of air using two nitrogen recycle streams and two split feed air streams to the rectification column of the cryogenic air distillation.

BACKGROUND OF THE PRIOR ART

The prior art has recognized the need to perform air separation, particularly for the recovery of nitrogen with greater efficiency. With the increasing cost of energy and the need for large quantities of separated gas such as nitrogen for enhanced petroleum recovery, highly efficient separation processes and apparatus are necessary to provide competitive systems for the separation and production of the components of air, most particularly nitrogen.

The prior art has attempted to provide such efficiencies with various systems using the integration of process streams in an air separation plant, as well as various forms of autorefrigeration produced from the expansion of a high pressure stream in an expansion turbine or the flashing of a process stream through a JT valve.

In U.S. Pat. No. 2,627,731 a process for the rectification of air into oxygen and nitrogen is described wherein a two sectioned or single distillation column are used alternatively. Air is cooled by heat exchange and introduced directly into the distillation column. A nitrogen product is removed from the overhead of the column and a portion is compressed in two stages. The first stage nitrogen compressed stream is recycled in order to reboil and condense a portion of the midpoint of the column by indirect heat exchange before being introduced into the overhead of the column as reflux. A second stage compressed nitrogen stream is recycled and partially expanded to provide refrigeration. This expanded stream is recycled to the nitrogen product line. The remaining stream of the second stage compressed nitrogen stream reboils the bottom of the column before being combined with the first stage compressed nitrogen stream and introduced into the overhead of the column as reflux.

In U.S. Pat. No. 2,982,108, an oxygen producing air separation system is set forth wherein a portion of the nitrogen generated from the distillation column is compressed and reboils the base of a high pressure section of the column before being introduced as reflux to the low pressure section of the column. The feed air stream is supplied in separate substreams into the high pressure section of the column and in an expanded form into the low pressure section of the column.

U.S. Pat. No. 3,492,828 discloses a process for the production of oxygen and nitrogen from air wherein a nitrogen recycle stream is compressed and condensed in a reboiler in the base of a distillation column before being reintroduced into the column as reflux. A portion of the nitrogen recycle stream may be expanded in which the power provided by the expansion drives the compressor for the main nitrogen recycle stream.

In U.S. Pat. No. 3,736,762, a process for producing nitrogen in gaseous and liquefied form from air is set forth. A single distillation column is refluxed with nitrogen product condensed in an overhead condenser operated by the reboil of oxygen conveyed from the bottom of said column. At least a portion of the oxygen from the overhead condenser is expanded to produce refrigeration for the separation.

In U.S. Pat. No. 4,222,756, a process is set forth in FIG. 4 in which a two pressure distillation column is used in which both pressurized column sections are refluxed with an oxygen-enriched stream. The low pressure column is fed by a nitrogen-enriched stream from the high pressure column which is expanded to reduce its pressure and temperature.

U.S. Pat. No. 4,400,188, commonly assigned, discloses a nitrogen production process wherein a single nitrogen recycle stream refluxes a distillation column which is fed by a single air feed. Waste oxygen from the column is expanded to provide a portion of the necessary refrigeration.

Although the prior art has taught numerous systems for the separation of air and particularly the production of a nitrogen product from air, these systems have been unable to achieve the desired efficiencies in power consumption and product recovered which are necessary in the production of large volumes of air components, such as nitrogen. The present invention using significant integration of process streams achieves greater efficiency in the production of air components, such as nitrogen, particularly for large volumes of gaseous product.

BRIEF SUMMARY OF THE INVENTION

The present invention is directed to a system for the separation of air by cryogenic distillation in a distillation column in which a feed air stream is compressed to an elevated pressure and aftercooled against an external cooling fluid. Condensed liquid impurities are removed in a knock-out drum before the high pressure feed air stream is dried in a dryer by removing moisture and carbon dioxide in a molecular sieve bed. The feed air stream is then split into a sidestream and a remaining stream before the remaining stream is cooled against process streams in a heat exchanger. The cooled remaining stream is then introduced into a distillation column. The sidestream is compressed in a supplemental compressor to a further elevated pressure and then aftercooled before being cooled in the heat exchanger against process streams and then cooled in an air reboiler in the distillation column before the sidestream is reduced in pressure and introduced into the distillation column as feed. A nitrogen product stream is removed as an overhead stream from the column and a portion is condensed in a condenser against an oxygen-enriched stream before the portion of the nitrogen product stream is returned to the column as reflux. The remaining nitrogen product stream is removed and rewarmed by heat exchange in the heat exchangers against process streams. The rewarmed nitrogen product stream is then compressed in a first nitrogen product compressor to an intermediate pressure level. A first nitrogen recycle stream is separated from the compressed nitrogen product stream and is cooled against process streams in the heat exchanger before reboiling the distillation column in a nitrogen recycle reboiler and introduced into the column, after flashing to a lower temperature and pressure, as reflux. The compressed nitrogen product stream remaining after the first nitrogen recycle stream is removed, is further compressed in a second nitrogen product compressor to a high pressure level, and a second nitrogen recycle stream is split from the high pressure nitrogen product stream and is recycled and cooled through the heat exchangers against process streams before being expanded in an expander, such as an expansion turbine, and reintroduced into the first nitrogen recycle stream. The oxygen-enriched bottom stream from the distillation column is conveyed to the outside shell of the condenser at the top of the column in order to condense a nitrogen reflux while the oxygen-enriched product reboils. The reboiled oxygen-enriched product is removed and rewarmed by heat exchange against process streams in the heat exchanger.

Preferably, the nitrogen recycle expander provides power to operate the supplemental air compressor.

Advantageously, the nitrogen recycle reboiler is located above the feed air sidestream reboiler.

Preferably, the oxygen-enriched stream from the bottom of the distillation column is flashed through a JT valve before introduction into the outer shell of the condenser of the distillation column in order to reduce its temperature and pressure. Additionally, the oxygen-enriched stream can be used to reactivate the molecular sieve dryer.

Advantageously, the molecular sieve dryer is comprised of a pair of switching adsorption beds in which both beds are packed with a molecular sieve material and used alternately for adsorption and regeneration.

Alternately, the second nitrogen recycle stream can be individually returned to the column, after expansion, through a third reboiler located above the other reboilers in the column.

DETAILED DESCRIPTION OF THE INVENTION

Figure 1:
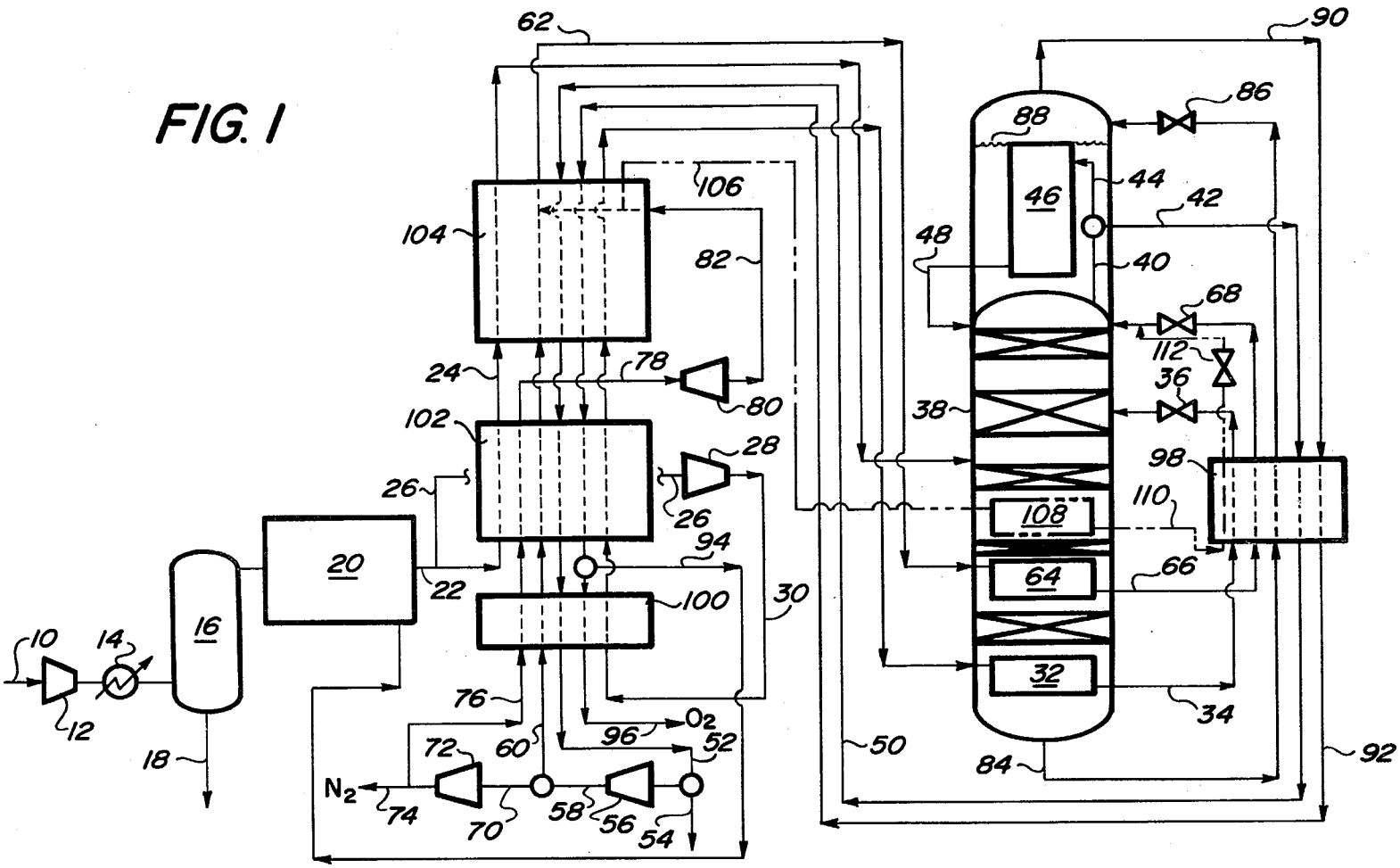
FIG. 1 is a schematic flow scheme of a preferred embodiment of the present invention.

The present invention will now be described in greater detail with respect to a preferred embodiment of the invention. With reference to FIG. 1, a feed air stream is introduced into the system in line 10 and is compressed to an elevated pressure in the main air compressor 12. The heat of compression is removed from the air stream by heat exchange against an external cooling fluid, such as water at ambient conditions, in heat exchanger or aftercooler 14. The high pressure aftercooled feed air stream is then introduced into a knock-out drum 16 wherein condensed water and other heavy components, such as hydrocarbons, are removed as a liquid phase in drain line 18. Most of the condensables are removed in this apparatus, but residual moisture and carbon dioxide are still entrained in the feed air stream. To remove the residual water and carbon dioxide, the feed air stream is directed through a molecular sieve bed 20. The molecular sieve bed is preferably a pair of adsorption beds which are packed with a molecular sieve adsorbent. While one bed is in the adsorption stage removing water and carbon dioxide from the feed air stream, the other bed is in a regeneration stage in which a dry regeneration gas, preferably a process stream, such as a waste oxygen-enriched stream, is passed through the regenerating adsorption bed to remove adsorbed water and carbon dioxide. The duty on the beds is switched in a timed sequence corresponding to the adsorption capacity of the beds. Such an apparatus is generally referred to as a dryer and is known in the art specifically as switching adsorption beds.

The compressed and dried feed air stream in line 22 is then separated into a feed air sidestream 26 and a remaining feed air stream 24. The remaining feed air stream 24 is cooled by heat exchange in heat exchangers 102 and 104 against process streams. This feed air stream is introduced into a single pressure distillation column 38 at an intermediate level. The feed air sidestream in line 26 is compressed to a higher pressure in a supplemental air compressor 28 and aftercooled against external cooling fluid, such as ambient water. This cooling is not shown in the drawing. The high pressure sidestream in line 30 is then cooled in heat exchangers 100, 102 and 104 by heat exchange against process streams.

The sidestream in line 30 is then used to reboil the distillation column 38 in an air reboiler 32 which is located near the bottom of the column 38. The sidestream is condensed in the reboiler 32 as the sidestream heat exchanges with the bottoms liquid which is reboiled to send vapors upward through the column. The condensed sidestream is removed from the reboiler 32 in line 34 and is further cooled in subcooling heat exchanger 98 before being flashed through a JT valve 36 to a lower temperature and pressure before being introduced into the distillation column above the feed inlet of the remaining air stream.

An oxygen-enriched stream is removed from the bottom of the column 38 in line 84. This stream contains approximately 50 to 80% oxygen depending upon the overall nitrogen recovery of the system. The oxygen-enriched stream in line 84 is further cooled in subcooling heat exchanger 98 before being flashed to a reduced temperature and pressure through JT valve 86 and introduced into the sump outside the column condenser 46. The oxygen-enriched phase 88 in heat exchange communication with the condenser 46 is reboiled against a nitrogen product removed from the top of the column in line 40. A nitrogen product stream is removed from the top of the column in line 42, while a nitrogen reflux stream is directed in line 44 through the condenser 46 to be condensed against the reboiling oxygen-enriched phase 88 and reintroduced into the distillation column 38 by line 48 as a reflux stream for the distillation column.

The vapor phase of the oxygen-enriched phase 88 in the overhead of the distillation column 38 is removed in line 90 and rewarmed against process streams in subcooling heat exchanger 98. The warmed oxygen-enriched stream in line 92 is then further rewarmed against process streams in heat exchanger 104, 102 and 100. A portion of the oxygen-enriched stream is removed before passage through heat exchanger 100 in line 94 and is used to regenerate the dryer 20, specifically the regeneration of the molecular sieve bed presently in the regeneration stage. This gas, the oxygen-enriched stream, is essentially free of water and carbon dioxide and readily desorbs such components from the adsorbent material in the bed during the regeneration sequence. The spent regeneration gas may then be vented or used for utility requiring oxygen-enrichment where water and carbon dioxide do not present a problem. The remaining oxygen-enriched stream passes through heat exchanger 100 and is further rewarmed before leaving the system in line 96. Again, the oxygen-enriched stream in line 96 may be used for utilities requiring oxygen-enrichment, but this stream is also free of water and carbon dioxide. Alternately, the stream may be vented to atmosphere.

The nitrogen product stream removed from stream 40 in line 42 contains essentially pure nitrogen which is rewarmed in subcooling heat exchanger 98 against process streams. The nitrogen product stream now in line 50 is further rewarmed by heat exchange against process streams in heat exchanger 104, 102 and 100. The nitrogen product stream now in line 52 can be used in part for reactivation or purge duty in the system by removing a minor stream in line 54. The major portion of the nitrogen product stream in line 52 is then compressed to an intermediate elevated pressure in compressor 56. The intermediate pressure level nitrogen product stream in line 58 is then split into a first nitrogen recycle stream 60 and a remaining nitrogen product stream in line 70.

The first nitrogen recycle stream in line 60 is cooled by heat exchange against process streams in heat exchangers 100, 102 and 104.

The nitrogen product stream in line 70 is then further compressed in compressor 72 to a high pressure level in line 74. The major portion of this high pressure level nitrogen product stream is removed as product from the system. A portion of the high pressure level nitrogen product is separated as a second nitrogen recycle stream in line 76. This second nitrogen recycle stream in line 76 is cooled by heat exchange against process streams in heat exchangers 100 and 102. The partially cooled second nitrogen recycle stream now in line 78 is expanded back down to the intermediate pressure level of the first nitrogen recycle stream in an expansion turbine or expander 80. This expander produces power which may be utilized to drive the supplemental air compressor 28 for the compression of the feed air sidestream 26. The expander 80 provides refrigeration in the form of a low temperature, low pressure second nitrogen recycle stream in line 82 which is then combined with the first nitrogen recycle stream in the heat exchanger 104. The combined nitrogen recycle stream in line 62 is then introduced into the recycle reboiler 64 situated in the lower portion of the distillation column 38, above the air reboiler 32. The recycle reboiler 64 is in a cooler portion of the rectifying air in the distillation column 38 which allows for a lower recycle stream pressure. The recycle stream reboils the rectifying streams in the column while condensing the nitrogen recycle stream which is removed in line 66. The combined nitrogen recycle stream is then subcooled in subcooling heat exchanger 98 against process streams. The subcooled combined nitrogen recycle stream is reduced in temperature and pressure by passage through a JT valve 68 before being introduced into the top of the distillation column 38 as reflux.

Alternately, the nitrogen recycle stream in line 82 may be individually recycled through exchanger 104, line 106 and column reboiler 108, wherein the nitrogen is condensed and the column is reboiled. Then the recycle stream in line 110 passes through exchanger 98 before being introduced into the column 38 together with the stream in line 66 or individually. There may be optional trays between reboilers 64 and 108.

Although not shown, a liquid stream is withdrawn from the condenser 46 and is passed through a guard adsorber to prevent hydrocarbon buildup. This stream then passes through a heat pump and re-enters the condenser 46. A small liquid purge is also taken off the condenser 46 for the same purpose.

The use of dual nitrogen recycle streams in which the second nitrogen recycle stream is expanded to a lower pressure allows for the production of refrigeration by that recycle stream so that the air pressure for the overall system may be set by the pressure drop of the stream 90 through the system, rather than at a higher level necessary to produce refrigeration. If refrigeration were provided by expansion of waste oxygen-enriched gas, as is taught in U.S. Pat. No. 4,400,188, the pressure of the distillation column is required to be at a much higher level to provide the refrigeration requirements. At higher column pressure, the separation of air is more difficult and requires a greater volume flow rate and high pressure for the nitrogen recycle. This requires additional power. Therefore the present invention provides an economy in the operation of the air separation system. A pressure reduction of the nitrogen recycle stream 62 is also achieved by the use of dual reboilers wherein the air reboiler 32 allows the nitrogen recycle reboiler 64 to be located at a higher level in the distillation column amidst a colder portion of the gas stream being rectified in the distillation column. This allows for a reduced pressure level and a reduced flow of the nitrogen recycle stream, which again helps to economize on the power required for the system. At lower column pressure, the present invention allows greater nitrogen recovery at reduced air feed and therefore a smaller compressor size such as compressor 12.

This process is particularly attractive when nitrogen product is required at high pressure in large quantities, although nitrogen at 40 psig can be produced, such as in the enhanced recovery of petroleum wherein nitrogen is used to maintain the pressure in a petroleum production well. The two stage compressors 56 and 72 provide such high pressure nitrogen while at the same time providing a source of refrigeration by the expansion of a portion of the high pressure nitrogen recycle in the expansion turbine or expander 80. Efficient utilization of the power derived from this expansion is realized by the use of the expander generated power in the compressor of the feed air sidestream 26. The expander 80 and the compressor 28 can be interconnected in any known manner, such as by an electrical connection between an expander power generator and an electric motor driven compressor, or preferably by the mechanical linkage of the expander to the compressor in what is known in the art as a compander. This provides particularly efficient utilization of the power provided in the expander in the compression of the air feed in the compressor 28. The present invention will now be further described with reference to an example of air separation for the recovery of nitrogen gas at high pressure.

EXAMPLE

A feed air stream is introduced in line 10 into the air separation apparatus and compressed and aftercooled to a pressure of about 66 psia and a temperature of 40° F. Approximately 93% of the feed air after drying is passed through the heat exchangers 102 and 104 and cooled to a temperature of −277° F. before being introduced as feed into the distillation column for rectification at a pressure of about 61 psia. About 7% of the feed air is split from the feed stream and is removed as a feed air sidestream in line 26. It is further compressed at 28 to a pressure of 106 psia and then aftercooled before being cooled in heat exchangers 100, 102 and 104 and introduced into the air reboiler 32 at about −272° F. as vapor. The sidestream reboils the column while being condensed and leaves the reboiler at about −279° F. It is then cooled in the exchanger 98 and introduced into the column 38 as a second feed at approximately −290° F. An oxygen-enriched stream containing 66% oxygen is removed from the base of the column, is cooled, reduced in pressure and introduced into the overhead of the column outside the shell of the overhead condenser to condense a nitrogen reflux stream. The liquid oxygen is at approximately −305° F. Gaseous oxygen is then removed in line 90. A pure nitrogen product having 2 ppm of oxygen is removed in line 42 and is rewarmed before being compressed at 56 to about 126 psia. About 17% of the product is recycled in line 60, while the remaining nitrogen product is compressed at 72 to about 356 psia. A second recycle stream is removed from the nitrogen product stream. This recycle constitutes 16% of the nitrogen product in line 52. The second nitrogen recycle stream is expanded at 80 to a temperature of −240° F. and a pressure of 120 psia. The recycle streams are combined, sent to reboil at 64 and are reduced in temperature and pressure so as to enter the column as reflux at approximately −296° F. The system, as run, provides gaseous nitrogen at high pressure, approximately 350 psia, and recovers approximately 88% of the total nitrogen processed by the system.

The present invention provides a favorable improvement over known nitrogen generating air separation systems. As shown in Table 1 below, the present invention provides nitrogen at a reduced power requirement over a commonly assigned patented cycle disclosed in U.S. Pat. No. 4,400,188. The calculated power reduction of over 4% is believed to be a significant reduction in air separation systems.

TABLE 1

| | U.S. PAT. NO. 4,400,188 | PRESENT INVENTION |
|---|---|---|
| Power Required: | 0.230 KWH/NM$^3$ | 0.221 KWH/NM$^3$ |
| Percent Improvement: | — | 4.1% |

The basis of the evaluation was at 50 MMSCFD, at nitrogen product of 5736 lb. moles/hr., at 2 ppm oxygen purity, ambient conditions of; 14.7 psia, 85° F. and 60% relative humidity, and product pressure at 213 psia.

Such a significant power efficiency advantage provides a major benefit in the low cost production of air components in large volumes, such as nitrogen gas. Additionally, this large volume nitrogen product is provided at pressures at or above 50 psia, depending on the end use requirements.

The present invention has been set forth with regard to a specific preferred embodiment, but those skilled in the art will recognize obvious variations which are deemed to be within the scope of the invention, which scope should be ascertained from the claims which follow.

We claim:

1. A process for the separation of air by cryogenic distillation of the air in a distillation column comprising the steps of:

(a) compressing a feed air stream to an elevated pressure and aftercooling the pressurized air stream;
(b) removing water and carbon dioxide from the cooled pressurized air stream;
(c) splitting the feed air stream into a sidestream and a remaining stream;
(d) cooling the remaining stream in heat exchange against other process streams before introducing it into a distillation column;
(e) compressing the sidestream and cooling it in heat exchange against process streams;
(f) reboiling the distillation column with the compressed sidestream before reducing the pressure of the sidestream and introducing it into the column;
(g) separating a nitrogen product stream and an oxygen-enriched stream from said distillation column;
(h) condensing a portion of the nitrogen product stream against the oxygen-enriched stream and returning it to the column as reflux;
(i) rewarming the remaining nitrogen product stream by heat exchange against process streams and compressing at least a portion of the product stream to an intermediate elevated pressure;
(j) splitting a first nitrogen recycle stream from the compressed nitrogen product stream and cooling it against process streams;
(k) further compressing at least a portion of the nitrogen product stream and splitting a second nitrogen recycle stream from the nitrogen product stream before expanding said second recycle stream in an expander to a lower temperature and pressure and introducing it into the first recycle stream to form a combined recycle stream;
(l) reboiling the distillation column with said combined recycle stream before reducing it in pressure and introducing it into the column as reflux.

2. The process of claim 1 wherein the expansion of the second recycle stream provides the power for the compression of the sidestream.

3. The process of claim 1 wherein the sidestream reboils the column below the reboil of the recycle stream.

4. The process of claim 1 wherein the oxygen-enriched stream is removed from the column condenser and rewarmed in heat exchange against process streams.

5. The process of claim 1 wherein the feed air stream is passed through a molecular sieve adsorbent bed to remove residual water and carbon dioxide.

6. The process of claim 1 wherein the oxygen-enriched stream is removed from the bottom of the distillation column, cooled by heat exchange against process streams and then reduced in temperature and pressure before being supplied to the condenser of the distillation column.

7. An apparatus comprising elements designed, sized and arranged for the separation of air by cryogenic distillation, including;

(a) a compressor for compressing a feed air stream to an elevated pressure;
(b) a drier for removing moisture and carbon dioxide from the compressed feed air stream;
(c) heat exchange means for cooling the feed air stream against process streams;
(d) a distillation column for rectifying the feed air stream into a nitrogen product stream and an oxygen-enriched stream;
(e) means for separately conveying a sidestream and a remaining feed air stream through said heat exchange means and to said distillation column;
(f) a supplemental compressor for increasing the pressure of the sidestream;
(g) an air reboiler for reboiling the distillation column with the sidestream by heat exchange before introducing the latter into the distillation column as feed to said column;

(h) means for removing a nitrogen product stream from said column and rewarming it by heat exchange against process streams;

(i) a first nitrogen product compressor for increasing the pressure of at least a portion of the nitrogen product stream to an intermediate level;

(j) means for separating and recycling a first nitrogen recycle stream to said distillation column including a recycle reboiler in which the nitrogen recycle stream reboils the column by heat exchange before being introduced into the column as reflux;

(k) a second nitrogen product compressor for increasing the pressure of at least a portion of the nitrogen product stream to a high level;

(l) means for separating and recycling a second nitrogen recycle stream from said nitrogen product stream to said column including an expander for reducing the temperature and pressure of said second nitrogen recycle stream.

8. The apparatus of claim 7 wherein the expander for the second nitrogen recycle stream is mechanically linked to the supplemental compressor in order to provide the power to drive said compressor.

9. The apparatus of claim 7 including means for conveying the oxygen-enriched stream from the bottom of said distillation column to a condenser on the top of said column.

10. The apparatus of claim 8 including means for reducing the pressure on the oxygen-enriched stream before introduction to the outer shell of the column condenser.

11. The apparatus of claim 7 including means for conveying a portion of said nitrogen product stream from the top of said column and condensing it in a condenser in order to return it as reflux to said column.

12. The apparatus of claim 10 including means for conveying the oxygen-enriched stream from the outside shell of the column condenser through said heat exchange means and removal from the apparatus.

13. The apparatus of claim 7 including means for recycling said second nitrogen recycle stream through said reboiler for said first nitrogen recycle stream.

14. The apparatus of claim 7 including a separate reboiler for said second nitrogen recycle stream located above said reboiler of clause (j) in said column.

15. A process for the separation of air by cryogenic distillation of the air in a distillation column comprising the steps of:

(a) compressing a feed air stream to an elevated pressure and aftercooling the pressurized air stream;

(b) removing water and carbon dioxide from the cooled pressurized air stream;

(c) splitting the feed air stream into a sidestream and a remaining stream;

(d) cooling the remaining stream in heat exchange against other process streams before introducing it into a distillation column;

(e) compressing the sidestream and cooling it in heat exchange against process streams;

(f) reboiling the distillation column with the compressed sidestream before reducing the pressure of the sidestream and introducing it into the column;

(g) separating a nitrogen product stream and an oxygen-enriched stream from said distillation column;

(h) condensing a portion of the nitrogen product stream against the oxygen-enriched stream and returning it to the column as reflux;

(i) rewarming the remaining nitrogen product stream by heat exchange against process streams and compressing at least a portion of the product stream to an intermediate elevated pressure;

(j) splitting a first nitrogen recycle stream from the compressed nitrogen product stream and cooling it against process streams;

(k) reboiling the distillation column with said first nitrogen recycle stream before reducing it in pressure and introducing it into the column as reflux;

(l) further compressing at least a portion of the nitrogen product stream and splitting a second nitrogen recycle from the nitrogen product stream;

(m) expanding the second nitrogen recycle stream in an expander to lower temperature and pressure;

(n) reboiling the distillation column with said second nitrogen recycle stream separately from said first nitrogen recycle stream before reducing it in pressure and introducing it into the column as reflux.

* * * * *